US007205948B2

(12) United States Patent
Krikorian et al.

(10) Patent No.: US 7,205,948 B2
(45) Date of Patent: Apr. 17, 2007

(54) VARIABLE INCLINATION ARRAY ANTENNA

(75) Inventors: Kapriel V. Krikorian, Calabasas, CA (US); Robert A. Rosen, Simi Valley, CA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 11/135,691

(22) Filed: May 24, 2005

(65) Prior Publication Data

US 2006/0267850 A1 Nov. 30, 2006

(51) Int. Cl.
*H01Q 13/10* (2006.01)

(52) U.S. Cl. ..... 343/770; 343/767; 343/753; 343/754

(58) Field of Classification Search ..... 343/767, 343/770, 753, 754
See application file for complete search history.

(56) References Cited

U.S. PATENT DOCUMENTS 6,421,021 B1 7/2002 Rupp
6,677,899 B1 1/2004 Lee
6,822,615 B2 11/2004 Quan
6,861,996 B2 * 3/2005 Jeong ..... 343/770
6,894,654 B2 * 5/2005 Lynch ..... 343/771
6,919,854 B2 * 7/2005 Milroy et al. ..... 343/770
6,992,548 B2 * 1/2006 Fukunaga ..... 333/208
2004/0233117 A1 11/2004 Milroy

FOREIGN PATENT DOCUMENTS

EP 1 314 221 B 11/2004

OTHER PUBLICATIONS

Sikina T et al: "Variably Inclined Continuous Transverse Stub-2 Antenna" Phased Array Systems and Technology 2003, IEEE. International Symposium on Oct. 14-17, 2003, Piscathay NJ, USA, IEEE Oct. 14, 2003 Whole Document.

* cited by examiner

*Primary Examiner*—Hoang V. Nguyen
*Assistant Examiner*—Dieu Hien Duong
(74) *Attorney, Agent, or Firm*—Leonard A. Alkov

(57) ABSTRACT

An antenna array includes an upper conductive plate structure comprising a lattice array of holes to form a radiating aperture. A lower conductive plate structure is disposed in a spaced relationship relative to the upper plate structure. The lower plate structure has an upper surface whose spacing from a lower surface of the upper plate varies in a first direction parallel to the lower surface. The array includes relative rotation apparatus for imparting relative rotational movement between the upper plate structure and the lower plate structure.

40 Claims, 4 Drawing Sheets

Lattice Rotated, Beam Exiting Visible Space, but Another Beam Entering Visible Space

VARIABLE INCLINATION ARRAY ANTENNA

BACKGROUND

A variable inclination continuous transverse stub ("VICTS") antenna is disclosed in US 2004/0233177 A1. In some rapid scanning/wide area coverage applications, e.g., detection and tracking of munitions and geolocation of launchers, using a VICTS antenna, it may be desired to spin the VICTS cover plate or grill relative to the base at very high rates. During a complete revolution the beam will be in visible space less than half the time which degrades the search pattern and causes a slower scan. At high scan rates, the lack of rigidity of the grill may degrade the antenna performance.

Conventional mechanically scanned antennas cannot operate at very high scan rates (e.g., 360 degrees at 20 Hz rate). Electronically scanned antennas are expensive and are not yet available at millimeter waves.

SUMMARY OF THE DISCLOSURE

An antenna array includes an upper conductive plate structure comprising a lattice array of holes to form a radiating aperture. A lower conductive plate structure is disposed in a spaced relationship relative to the upper plate structure. The lower plate structure has an upper surface whose spacing from a lower surface of the upper plate varies in a first direction parallel to the lower surface. The array includes relative rotation apparatus for imparting relative rotational movement between the upper plate structure and the lower plate structure.

BRIEF DESCRIPTION OF THE DRAWINGS

Features and advantages of the disclosure will readily be appreciated by persons skilled in the art from the following detailed description when read in conjunction with the drawing wherein.

DETAILED DESCRIPTION

Figure 1:
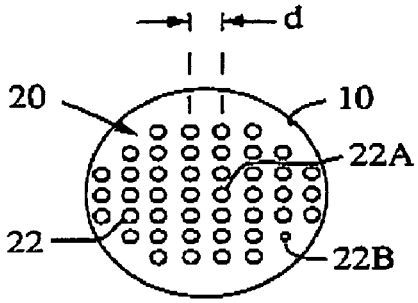
FIG. 1 is a top plan view of an exemplary embodiment of a variable inclination array (VIA) antenna cover plate with a square lattice or array of circular holes formed through the plate.

In the following detailed description and in the several figures of the drawing, like elements are identified with like reference numerals.

An exemplary embodiment of a VIA antenna employs a cover plate with a lattice of holes, rather than a linear grill forming transverse stubs. This embodiment of the VIA antenna provides higher structural rigidity, and reduces the dead angular region of the cover plate where the beam is outside visible space. Thus, in a simple scan method of a constantly turning cover plate, the antenna may radiate and receive for a higher fraction of the time than with a linear grill. Another advantage is that the polarization would remain justified to the base, thus simplifying monopulse calibration.

In an exemplary embodiment, the hole lattice has symmetry under a 90 degree rotation, so that an identical hole pattern is presented with the cover plate at a first angular position and at a second angular position rotated 90 degrees relative to the first angular position. In other embodiments the symmetry can be with respect to other rotational positions less than 180 degrees. For example, a hexagonal lattice may be employed, with symmetry under a 60 degree rotation. In other embodiments, the symmetry may be with respect to rotation through 360/N degrees, where N is an integer greater than 2.

FIG. 1 is a top plan view of an embodiment of a VIA cover plate 10 with a symmetrical lattice or array 20 of circular holes 22 formed through the plate, formed on a center-to-center spacing d. This will provide the radiating aperture 4 fold symmetry. The grill may also be structurally stiffer than a linear grill, raising its natural vibration frequency.

Figure 2:
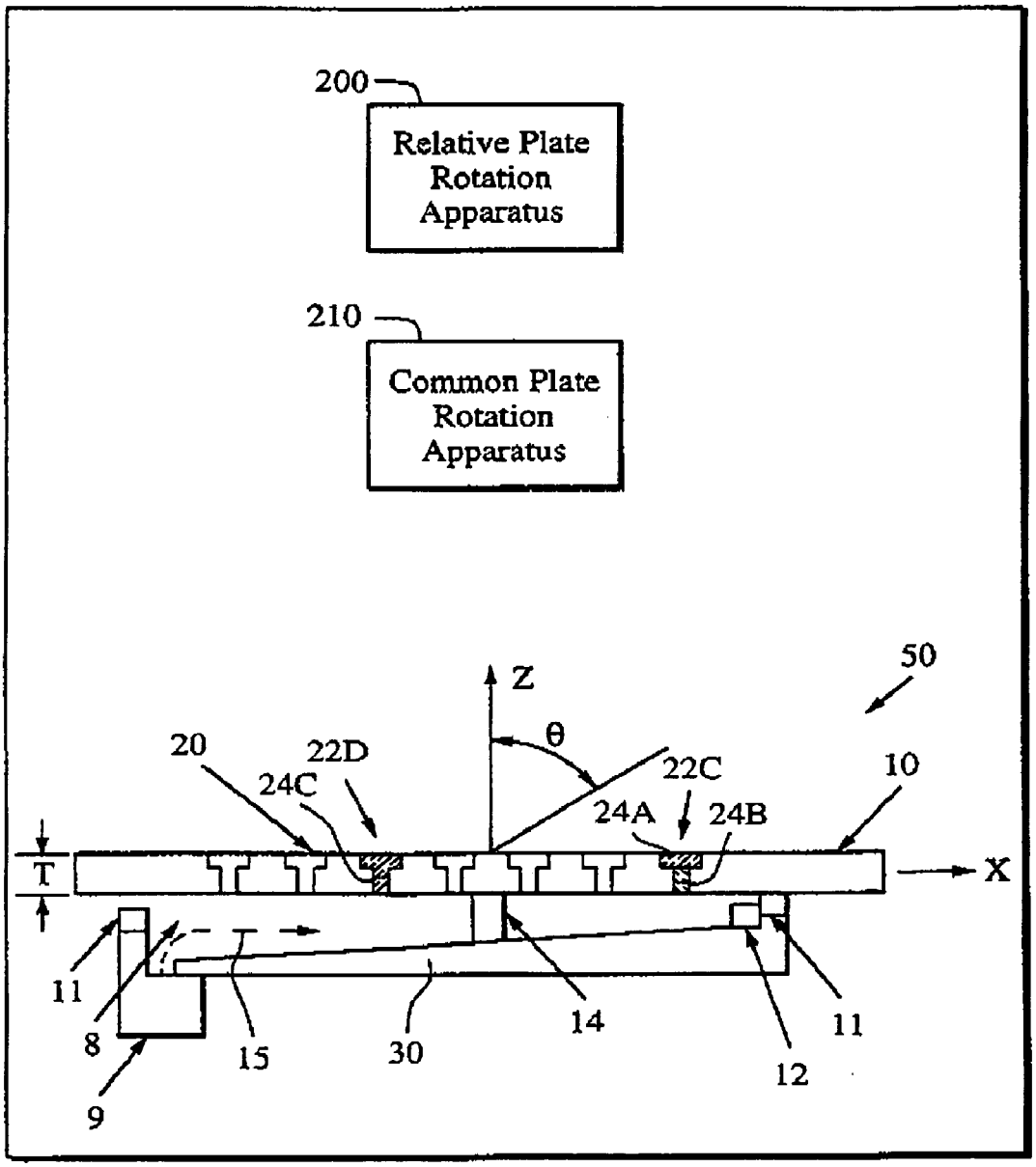
FIG. 2 is a simplified cross-sectional view of an exemplary embodiment of a VIA antenna with a cover plate.

FIG. 2 is a cross-section of a VIA antenna with a cover plate 10 showing in cross-section the cover plate 10 and lower conductive plate 30. The lower conductive plate 30 is made in such a way that its cross-section varies in height in the positive z-direction as a function of x-coordinate as shown. Both plates are located in X, Y, Z space in such a way that they are centered about the z-axis. An optional dielectric support 14 may be disposed along the z-axis and acts as a support between the upper and lower plates.

The top surface of the lower plate 30 and the lower surface of plate 10 form a quasi-parallel plate transmission line structure that possesses plate separation that varies with x-coordinate. Plate 10 along with the upper surface of plate 30 form a radiating array, with the parallel plate spacing varying in one dimension. The upper plate 10 can be fabricated from a solid conductive plate in one exemplary embodiment.

Still referring to FIG. 2, the array 50 may be excited from below at one end 8 by a generic linear source 9. A traveling-wave, referred to below as the base wave, consisting of or including parallel-plate modes, is created by the source 9 between the lower surface of the upper plate and the upper surface of the lower plate. This wave propagates in the positive x-direction. Plane wave-fronts associated with the base wave are contained in planes parallel to the Y-Z plane. Dotted arrow 15 indicates the direction of rays associated with this wave in a direction perpendicular to the Y-Z plane. As the base wave propagates in the positive x-direction away from the linear source 9, corresponding longitudinal surface currents flow on the lower surface of the upper plate and the upper surface of the lower plate in the positive x-direction. The currents flowing in the upper plate are periodically interrupted by the presence of the openings 20. As such, separate traveling waves are coupled into each opening that travel in the positive z-direction to the top surface of the upper plate and radiate into free space.

The collective energy radiated from all the openings 10 causes an antenna pattern to be formed far away from the upper surface of the upper plate. The antenna pattern will show regions of constructive and destructive interference or sidelobes and a main beam of the collective waves and is dependent upon the frequency of excitation of the waves and geometry of the VIA array. The radiated signal will possess linear polarization with a very high level of purity. The opening centerline to centerline spacing, d, may be selected such that the main beam is shifted slightly with respect to the mechanical boresight of the antenna defined by the z-axis.

Any energy not radiated into free space will dissipate in an rf energy-absorbing load 12 placed after the final opening 10 in the positive x-direction. Non-contacting frictionless rf chokes, 11, placed before the generic linear source (negative x-direction) and after the rf energy-absorbing load (positive x-direction) prevent unwanted spurious radiation of rf energy.

Figure 3A:
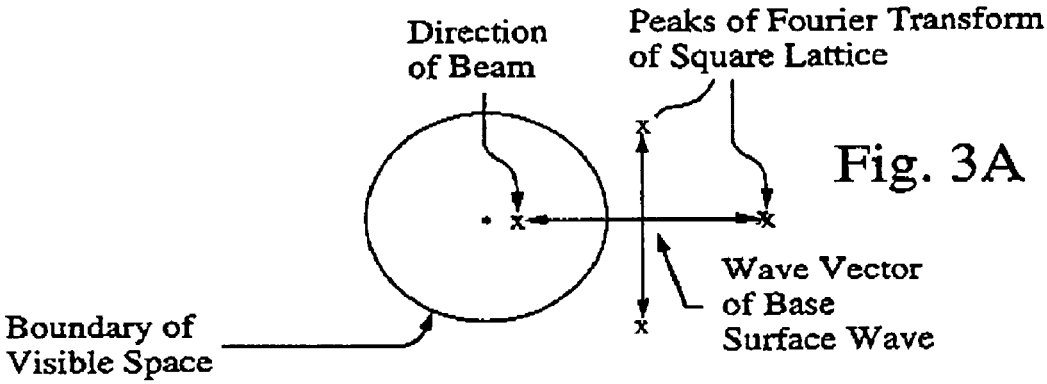
FIGS. 3A–3B diagrammatically illustrate the peaks of the Fourier transform of a square pattern of holes with four point symmetry.
Figure 3B:
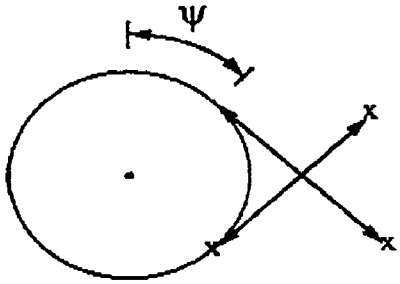

If the upper plate 10 is rotated or inclined in a plane parallel to the X-Y plane as shown in FIG. 3B by some angle ψ, the effect of such a rotation is that the orientation of the openings relative to the fixed incident waves emanating from the source is modified. As the waves travel away from the source towards the openings, rays incident upon a column of openings towards the top, (positive y-coordinate) of the parallel plate region arrive later in time than rays incident towards the bottom of the parallel plate region (negative y-coordinate). Consequently, waves coupled from the parallel plate region to the openings will possess a linear progressive phase factor along the column parallel to Y' and a smaller linear progressive phase factor perpendicular to the column along the X' axis. These two linear phase factors cause the radiated planar phase front x from the antenna to make an angle with the mechanical boresight (along the z-axis) of the antenna that is dependent on Ψ. This leads to an antenna pattern whose main beam is shifted or scanned in space.

The amount of change in the linear progressive phase factors and correspondingly the amount of scan increases with increasing Ψ. Further, both plates 10 and 30 may be rotated simultaneously to scan the antenna beam in azimuth. Overall, the antenna beam may be scanned in elevation angle, θ, up to ninety degrees and in azimuth from zero to three hundred and sixty degrees through the differential and common rotation of plates 10 and 30 respectively. Moreover, the antenna beam may be continuously scanned in azimuth in a repeating three hundred and sixty-degree cycle through the continuous rotation of plates 10 and 30 simultaneously.

In general the required rotations for the above described embodiments may be achieved through various means illustrated schematically in FIG. 2 as relative plate rotation apparatus 200 (providing relative rotation between the upper plate 10 and the lower plate 30) and common plate rotation apparatus 210 (commonly rotating the upper plate 10 and the lower plate 30), including but not limited to being belt driven, perimeter gear driven, or direct gear driven.

The hole size may be reduced towards the outer edge of the plate to provide aperture taper and additional rigidity. For example, hole 22B (FIG. 1) may have a reduced diameter relative to the diameter of hole 22A (FIG. 1). The rigidity may also be improved by dielectrically loading the holes, which allows them to be smaller while maintaining a sufficient margin relative to cutoff. Reflection from the holes is controlled over a wide bandwidth by making the upper plate thickness T (FIG. 2) an integral number of guided half wavelengths, stepping the hole size with depth, and or stepping the dielectric constant of the dielectric loading the holes. For example, hole 22C (FIG. 2) has a stepped hole size, and is filled with a first dielectric material 24A having a first dielectric constant and a second dielectric material 24B having a second dielectric constant, thus producing a stepped dielectric constant. Hole 22D is illustrated as being filled with a dielectric material 24C having a constant dielectric constant.

To avoid grating lobes, the hole spacing, d, may be at around one half wavelength (λ/2). Thus, in such an exemplary embodiment, the hole diameters will be less than d. In a thick plate, each hole could act as a circular waveguide below cutoff which would prevent radiation from the aperture. However, filling the holes with a moderate dielectric, e.g. with a relative dielectric constant on the order of 6, would allow radiation.

FIGS. 3A–3B diagrammatically illustrate the peaks of the Fourier transform of a square pattern of holes with four point symmetry, with the direction of the beam indicated. The pattern of the peaks of the Fourier transform is aligned with the grill but the center of the pattern is displaced by the base wave vector. The base wave vector is directed along the base wave and its magnitude is the base wave index of refraction. The index of refraction is the ratio of the speed of light in vacuum to the phase velocity of this wave. The projection of the line of sight to the mainlobe beam center is the location of peak within the unit circle. FIG. 3A illustrates the peaks at a first lattice angular position (Ψ=0); the four point symmetry is evident. FIG. 3B illustrates the peaks of the Fourier transform, with the lattice rotated by 45 degrees (Ψ=45E), and illustrating the beam exiting visible space, but with another beam entering visible space. Visible space is the interior of the unit circle in sine space. The sine space is the projection of the far field unit vector onto the antenna plane.

Figure 4A:
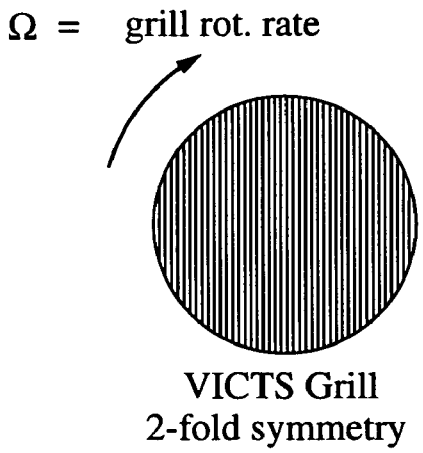
FIG. 4A depicts a linear CTS grill, with its two fold symmetry, rotating at a grill rotation rate Ω.
Figure 5A:
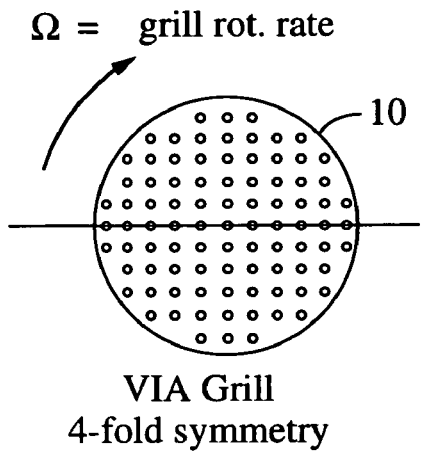
FIG.5A depicts a VIA grill with a hole lattice pattern.
Figure 4B:
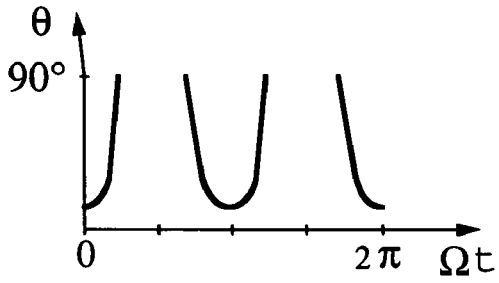
FIG. 4B shows the main lobe angular position as a function of the grill angular position, showing that the lobe rotates twice for each complete grill rotation.
Figure 5B:
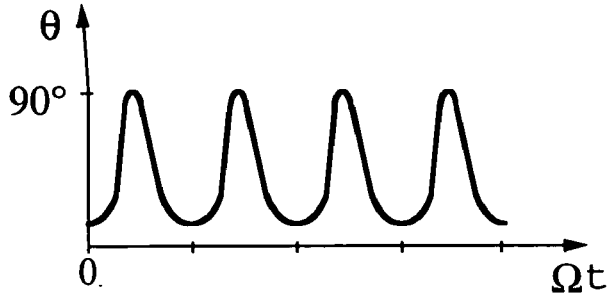
FIG. 5B shows the main lobe angular position as a function of the grill angular position.

FIG. 4A depicts a linear CTS grill, with its two fold symmetry, rotating at a grill rotation rate Ω, with the main lobe at polar angle Θ. FIG. 4B shows the main lobe angular position as a function of the grill angular position (Ωt, where t is the time), showing that the lobe rotates twice for each complete grill rotation. FIG. 5A depicts a grill with a square hole lattice pattern, and FIG. 5B shows the main lobe angular position as a function of the grill angular position Ωt, indicating a lower fraction of lead time with the beam outside visible space.

Figure 6:
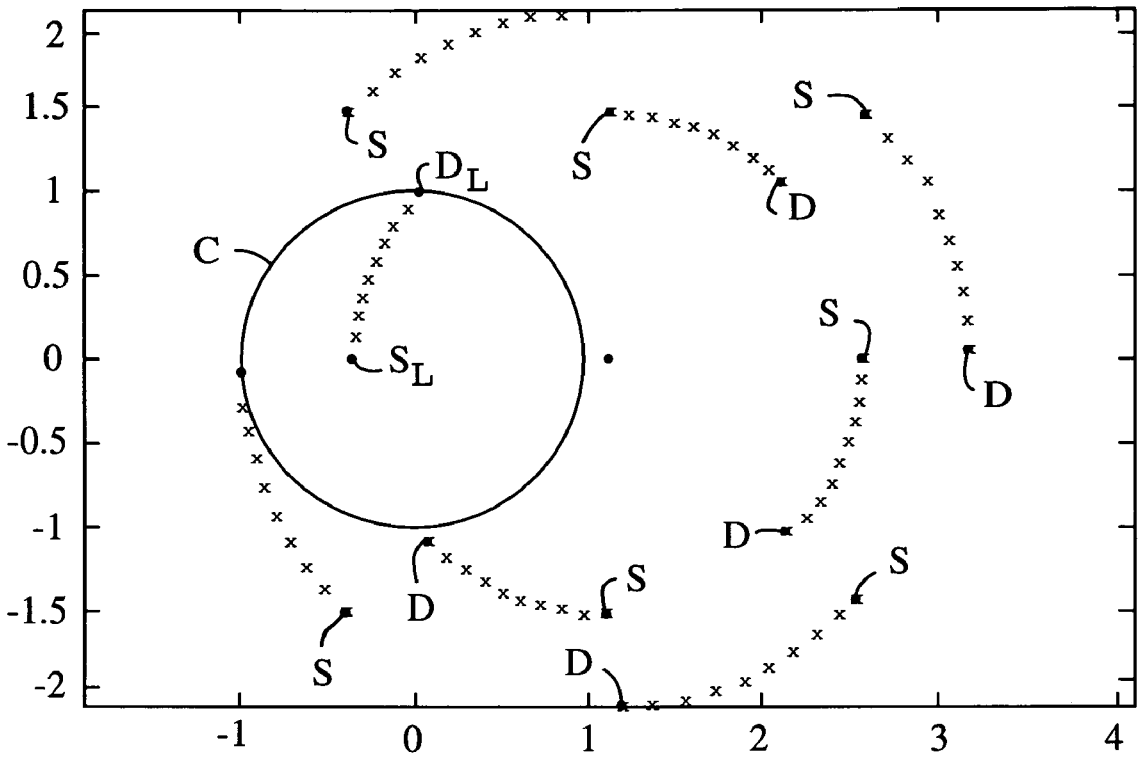
FIG. 6 is a graphical illustration of a locus of points in sine space of the main and grating lobes as an exemplary VIA grill with a square lattice hole pattern is rotated.

FIG. 6 is a graphical illustration of a locus of points in sine space of the main and grating lobes as an exemplary grill with a square lattice hole pattern is rotated. In this example, the center to center hole spacing is λ/1.48, and the effective index of refraction for the base wave is 1.1. The small circles indicate the starting location of the main and grating lobes when the grill is at the zero angle, with the main lobe SL closest to the mechanical boresight (22.5 degrees offset). The x=s indicate the loci of the lobes as the grill is rotated. The diamonds D indicate the lobe positions when the first main lobe exits visible space. The large circle C is the boundary of visible space. The four circles at (−0.38, 0), (1.1, 1.48), (2.48, 0), and (1.1, −1.48) are the current and future main lobes as the grill is rotated through 360 degrees. The circle at (−0.38, −1.48) represents a potential grating lobe. Note, however, that this potential grating lobe does not enter visible space until the main lobe exits. As the grill is turned a little further, this grating lobe will exit visible space just as the next main lobe enters visible space. Thus, the grating lobe does not degrade the antenna performance.

Although the foregoing has been a description and illustration of specific embodiments of the invention, various modifications and changes thereto can be made by persons skilled in the art without departing from the scope and spirit of the invention as defined by the following claims

What is claimed is:

1. An antenna array, comprising:

an upper conductive plate structure comprising a lattice array of holes formed there through to form a radiating aperture, wherein the lattice any of holes includes holes of reduced diameter towards an outer edge of the plate relative to holes toward a center of the lattice to provide aperture taper;

a lower conductive plate structure disposed in a spaced relationship relative to the upper plate structure, said lower plate structure having an upper surface whose spacing from a lower surface of the upper plate varies in a first direction parallel to said lower surface; and relative rotation apparatus for imparting relative rotational movement between said upper plate structure and said lower plate structure.

2. The array of claim 1, further including a dielectric material disposed in said holes.

3. The array of claim 1, wherein said lattice array of holes are formed on a center-to-center spacing d, and d is around one half wavelength (λ/2) at an operating frequency of the array.

4. The array of claim 1, wherein said upper plate has a thickness which is an integral number of guided half wavelengths at an array operating frequency.

5. The array of claim 1, wherein said holes have a stepped configuration as a function of hole depth.

6. The array of claim 1, wherein said holes are filled wit dielectric material of stepped dielectric constant.

7. The array of claim 1, wherein said upper plate structure is fabricated of a solid conductive plate.

8. The array of claim 1, further comprising an RF signal source for feeding the array with RE energy, the RE source disposed adjacent to an input region of a region between the upper plate structure and the lower plate structure, and an RE load disposed in a region distal from the input region for absorbing RE energy not radiated into free space by the array.

9. The array of claim 1, further comprising common rotation apparatus for commonly rotating the upper plate structure and the lower plate structure.

10. The array of claim 1, wherein the holes have a circular configuration.

11. The array of claim 1, wherein the upper conductive plate structure has a circular configuration.

12. The array of claim 1, wherein the lattice array of hales has symmetry under 90 degree rotation, so that an identical hole pattern is represented with the upper plate at a first angular position and at a second angular position rotated 90 degrees relative to the first angular position.

13. A variable inclination array, comprising:

an upper conductive plate structure comprising a lattice array of circular holes formed there through to form a radiating aperture;

a lower conductive plate structure disposed in a spaced relationship relative to the upper plate structure, said lower plate structure having an upper surface whose spacing from a lower surface of the upper plate varies in a first direction parallel to said lower surface; and relative rotation apparatus for imparting relative rotational movement between said upper plate structure and said lower plate structure; and wherein the lattice array of holes has symmetry under a 90 degree rotation, so that an identical hole pattern is presented with the upper plate at a first angular position and at a second angular position rotated 90 degrees relative to the first angular position.

14. The array of claim 13, further including a dielectric material disposed in said holes.

15. The array of claim 13, wherein said lattice array of holes are formed on a center-to-center spacing d, and d is around one half wavelength (λ/2) at an operating frequency of the array.

16. The array of claim 13, wherein the lattice of hales includes holes of reduced diameter towards an outer edge of the plate relative to holes toward a center of the lattice to provide aperture taper.

17. The array of claim 13, wherein said upper plate has a thickness which is an integral number of guided half wavelengths at an array operating frequency.

18. The array of claim 13, wherein said holes have a stepped configuration as a function of hole depth.

19. The array of claim 13, wherein said holes are filled with dielectric material of stepped dielectric constant.

20. The stray of claim 13, wherein said upper plate structure is fabricated of a solid conductive plate in which said holes are formed.

21. The array of claim 13, further comprising an RF signal source for feeding the array with RF energy, the RF source disposed adjacent to an input region of a region between the upper plate structure and the lower plate structure, and an RF load disposed in a region distal from the input region for absorbing RF energy not radiated into free space by the array.

22. The array of claim 13, further comprising common rotation apparatus for commonly rotating the upper plate structure and the lower plate structure.

23. The array of claim 13, wherein the upper conductive plate structure has a circular configuration.

24. A variable inclination array, comprising:

an upper conductive plate structure comprising a lattice array of circular holes formed there trough to form a radiating aperture;

a lower conductive plate structure disposed in a spaced relationship relative to the upper plate structure, said lower plate structure having an upper surface whose spacing from a lower surface of the upper plate varies in a first direction parallel to said lower surface; and relative rotation apparatus for imparting relative rotational movement between said upper plate structure and said lower plate structure; and wherein the lattice array of holes has symmetry under a 360/N degree rotation, where N is an integer greater than two, so that an identical hole pattern is presented with the upper plate at a first angular position and at a second angular position rotated 360/N degrees relative to the first angular position.

25. The array of claim 24, wherein said lattice array of holes are formed on a center-to-center spacing d, and d is around one half wavelength (λ/2) at an operating frequency of the array.

26. The array of claim 24, further comprising an RF signal source for feeding the array with RF energy, the RF source disposed adjacent to an input region of a region between the upper plate structure and the lower plate structure, and an RF load disposed in a region distal from the input region for absorbing RF energy not radiated into free space by the array.

27. The array of claim 24, further comprising common rotation apparatus for commonly rotating the upper plate structure and the lower plate structure.

28. The array of claim 24, wherein the upper conductive plate structure has a circular configuration.

29. An antenna array, comprising:

an upper conductive plate structure comprising a lattice array of holes formed there through to form a radiating aperture, wherein the lattice of array of holes has a symmetry under 90 degree rotation, so that an identical hole pattern is presented with the upper conductive plate at a first angular position and at a second angular position rotated 90 degrees relative to the first angular position;

a lower conductive plate structure disposed in a spaced relationship relative to the upper plate structure, said lower plate structure having an upper surface whose spacing from a lower surface of the upper plate varies in a first direction parallel to said lower surface; and relative rotation apparatus for imparting relative rotational movement between said upper plate structure and said lower plate structure.

30. The array of claim 29, further including a dielectric material disposed in said holes.

31. The array of claim 29, wherein said lattice array of holes are formed on a center-to-center spacing d, and d is around one half wavelength ($\lambda/2$) at an operating frequency of the array.

32. The array of claim 29, wherein the lattice of holes includes holes of reduced diameter towards an outer edge of the plate relative to holes toward a center of the lattice to provide aperture taper.

33. The array of claim 29, wherein said upper plate has a thickness which is an integral number of guided half wavelengths at an array operating frequency.

34. The array of claim 29, wherein said holes have a stepped on configuration as a function of hole depth.

35. The array of claim 29, wherein said holes are filled with dielectric material of stopped dielectric constant.

36. The array of claim 29, wherein said upper plate structure is fabricated of a solid conductive plate.

37. The array of claim 29, further comprising an RF signal source for feeding the array with RF energy, the RF source disposed adjacent to an input region of a region between the upper plate structure and the lower plate structure, and an RF load disposed in a region distal from the input region for absorbing RF energy not radiated into free space by the array.

38. The array of claim 29, further comprising common rotation apparatus for commonly rotating the upper plate structure and the lower plate structure.

39. The array of claim 29, wherein the holes have a circular configuration.

40. The array of claim 29, wherein the upper conductive plate structure has a circular configuration.

* * * * *